US007395622B2

(12) United States Patent
Malkovas

(10) Patent No.: US 7,395,622 B2
(45) Date of Patent: Jul. 8, 2008

(54) PROMOTIONAL DISPLAY SYSTEM WITH LOCKING ARM

(75) Inventor: Mykolas Malkovas, Essex, CT (US)

(73) Assignee: Structural Graphics, LLC, Essex, CT (US)

( * ) Notice: Subject to any disclaimer, the term of this patent is extended or adjusted under 35 U.S.C. 154(b) by 0 days.

(21) Appl. No.: 11/805,535

(22) Filed: May 22, 2007

(65) Prior Publication Data

US 2007/0220789 A1 Sep. 27, 2007

Related U.S. Application Data

(63) Continuation of application No. 10/934,714, filed on Sep. 3, 2004, now abandoned.

(60) Provisional application No. 60/501,276, filed on Sep. 9, 2003.

(51) Int. Cl.
*G09F 1/00* (2006.01)

(52) U.S. Cl. ..... 40/124.17; 40/124.08

(58) Field of Classification Search ..... 40/124.08, 40/124.17, 124.18, 124.19, 124.09, 750, 40/754, 755, 786; 229/92.8

See application file for complete search history.

(56) References Cited

U.S. PATENT DOCUMENTS

| | | | | | |
|---|---|---|---|---|---|
| 2,141,216 | A | * | 12/1938 | Mancuso | 40/124.19 |
| 2,148,279 | A | * | 2/1939 | Sandberg | 40/124.08 |
| 2,330,287 | A | * | 9/1943 | Horr | 40/539 |
| 2,533,874 | A | * | 12/1950 | Burr | 40/610 |
| 2,559,489 | A | * | 7/1951 | Wolf | 40/539 |
| 3,739,511 | A | * | 6/1973 | Freedman | 40/124.06 |
| 4,949,482 | A | * | 8/1990 | Price | 40/124.08 |
| 5,317,823 | A | * | 6/1994 | Brunt, II | 40/124.08 |

* cited by examiner

*Primary Examiner*—William L. Miller
(74) *Attorney, Agent, or Firm*—Melvin I. Stoltz

(57) ABSTRACT

By employing the present invention, a unique, pre-printed housing member which is quickly and easily assembled from a flat, generally two-dimensional configuration into a three-dimensional promotional display, along with an integrally affixed stabilizing and locking member is attained. Once the promotional display system is placed in its three-dimensional configuration, with the stabilizing/locking member activated, assurance is provided that the entire advertising/promotional display product is securely retained in the desired, eye-catching, visually exciting, three-dimensional configuration. In particular, in the present invention, the promotional display member incorporates an integral, arcuately pivotable, stabilizing/locking arm and stand combination which cooperates with one or more panel members of the housing to assure secure-ment of the promotional display system in its fully erected configuration when desired by the user.

11 Claims, 4 Drawing Sheets

PROMOTIONAL DISPLAY SYSTEM WITH LOCKING ARM

RELATED APPLICATIONS

This application is a Continuation Application of U.S. Ser. No. 10/934,714, filed Sep. 3, 2004 now abandoned entitled Promotional Display System with Locking Arm which is related to U.S. Provisional Patent Application Ser. No. 60/501,276, filed Sep. 9, 2003 entitled Promotional Display System with Locking Arm.

TECHNICAL FIELD

This invention relates to printed advertising or promotional products and, more particularly, to advertising or promotional products which are movable between a substantially flat configuration and an erectable three-dimensional holding system, along with an integrally affixed stabilizing and locking member.

BACKGROUND ART

With the ever increasing quantity of products and services being offered to consumers, substantial interest has been given to promotional systems for advertising such products and services. In this regard, a wide variety of advertising displays and promotional literature has been created and distributed to consumers. However, due to the deluge of material to which average consumers are constantly exposed, greater emphasis has been placed upon developing eye-catching, visual displays and promotional material which will receive consumer attention.

Although various novelty products and printed displays have been created in an attempt to satisfy this demand, these prior art products have failed to provide the desired interest generating result with production costs which advertisers are capable of justifying. In attempting to generate a unique advertising display, some prior art products have employed complex folding systems which produce a three-dimensional display when activated or unfolded. However, in spite of the unique visual appearance generated by such products, the overall cost of production and complexity of assembly of these systems has prevented such prior art systems from becoming popular.

Other prior art displays have attempted to generate consumer interest by providing unique visual images or other indicia as an integral part of the display. However, these prior art attempts have also failed to generate the consumer interest being sought, largely due to an inability to provide an easily erectable display which is both eye-catching and substantially permanent.

Therefore, it is a principal object of the present invention to provide a printed advertising or promotional product which is capable of being produced at a reasonable cost and provides an exciting, interest-generating display.

Another object of the present invention is to provide a printed advertising or promotional product having the characteristic features described above, which enables the consumer to quickly and easily erect and achieve a sturdy, permanent exciting eye-catching promotion.

Another object of the present invention is to provide a printed advertising or promotional product having the characteristic features described above which is capable of mass production and assembly.

A further object of the present invention is to provide a printed advertising or promotional product having the characteristic features described above which provides a unique, eye-catching, exciting and surprising display which is produced in response to action by the consumer, and remains stationary, providing a long-lasting visual display.

Other and more specific objects will in part be obvious and will in part appear hereinafter.

SUMMARY OF THE INVENTION

By employing the present invention, all of the difficulties and inabilities of the prior art are eliminated and a unique, hands-on, printed, visually exciting and interest-generating advertising/promotional display product is realized. These desirable results are achieved in the present invention by providing a unique, pre-printed housing member which is quickly and easily assembled from a flat, generally two-dimensional configuration into a three-dimensional promotional display, along with an integrally affixed stabilizing and locking member. In this way, once the promotional display system is placed in its three-dimensional configuration, with the stabilizing/locking member activated, assurance is provided that the entire advertising/promotional display product is securely retained in the desired, eye-catching, visually exciting, three-dimensional configuration.

In accordance with the present invention, a housing is provided which is constructed for rapid, virtually automatic, erection from a first, substantially two-dimensional configuration into a second, substantially three-dimensional configuration. Typically, the present invention incorporates a plurality of co-operating panel members each of which incorporates visually distinctive indicia formed thereon for providing a highly unique, exciting, visually stimulating display when in its three-dimensional configuration.

Although prior art constructions of this general nature do exist, the present invention provides substantially enhanced integrated features which are unique to promotional displays of this nature. In particular, in the present invention, the promotional display member incorporates an integral, arcuately pivotable, stabilizing/locking arm and stand combination which cooperates with one or more panel members of the housing to assure securement of the promotional display system in its fully erected configuration when desired by the user.

In accordance with the present invention, the visually exciting, interest generating, permanently erectable, stabilized advertising/promotional display member comprises a plurality of cooperating panel members which are constructed for being foldable in a substantially flat, compact configuration, while also being quickly and easily movable from the compact configuration into a fully erect, three-dimensional, visually exciting display configuration. The plurality of cooperating panel members may be constructed to form a diorama display, a rectangular shaped box display, a pyramid display, or any other comparable configuration incorporating a plurality of integrated, cooperating panel members.

Although promotional display systems having these general configurations have existed in the prior art, these prior/art configurations all suffer from the common failure of being unstable and easily collapsed, when not desired. However, by employing the stabilizing/locking arm/stand of the present invention, these prior art failures are completely overcome. In this way, the tendency of prior art constructions to randomly collapse or fall over is completely eliminated, and a fully stabilized, visually exciting and interest generating display is attained.

In one preferred embodiment of the present invention, the rear panel of the promotional display system of the present invention incorporates an arcuately pivotable combined arm and stand member affixed thereto. In the preferred construction of this embodiment, the arm/stand member is mounted to the rear panel of the display system in a manner which enables the stand portion to be foldable directly onto the rear surface of the panel in a first position, and arcuately pivoted about a pivot axis into a second position, wherein the stand portion extends substantially perpendicularly from the rear panel.

In addition, the combined arm/stand member of the present invention also incorporates an elongated arm portion integrally affixed to the stand portion and extending from the pivot axis in the opposite direction from the stand portion. Furthermore, the elongated arm portion and the stand portion are constructed for lying in substantially the same plane. As a result of this construction, when the arm/stand member is arcuately pivoted about the pivot axis, the stand portion is moved from overlying engagement with the rear surface of the rear panel to a position substantially perpendicular from the rear panel, while the arm portion moves from a position generally overlying the inside surface of the rear panel to a position extending inwardly from the inside surface of the rear panel, substantially perpendicularly therefrom.

In order to further enhance the permanent stability and display properties of the present invention, the preferred embodiment of the present invention also incorporates a cutout zone formed in the panel member directly adjacent the rear panel member. In addition, the inwardly extending arm member incorporates a ledge formed inwardly of the terminating end of the arm member. By employing this construction, a portion of the arm member extends through the cutout zone formed in the adjacent panel with the ledge of the arm member lockingly engaging the edge of the cutout zone. In this way, secure locked engagement of the arm with a panel member is realized and a substantially enhanced, stabilized construction is attained.

In addition, as discussed above, the preferred embodiment of the present invention also incorporates a stand portion which is intricately attached to the arm portion. By arcuately pivoting the stand portion to be positioned substantially perpendicularly to the rear surface of the rear panel member, a further structural support and stabilizing element is provided to enhance the securement of the display system of the present invention in its three-dimensional, erect configuration.

In the present invention, each panel member forming the display assembly incorporates an eye-catching, visual display for generating consumer interest in the particular product or service for which the display has been created. In this way, once the display assembly is placed in its three-dimensional, fully erect configuration and the arcuately pivotable, combined arm/stand member is fully engaged, all of the panels forming the display assembly are presented in an easily viewable position, and the resulting structure is maintained in a secure, rigid configuration, virtually incapable of unwanted collapse. In this way, the display assembly of the present invention can be placed wherever desired for long term use and enjoyment.

The invention accordingly comprises an article of manufacture possessing the features, properties, and the relation of elements which will be exemplified in the article hereinafter described, and-the scope of the invention will be indicated in the claims.

THE DRAWINGS

For a fuller understanding of the nature and objects of the invention, reference should be had to the following detailed description taken in connection with the accompanying drawings, in which.

DETAILED DISCLOSURE

By referring to FIGS. 1-12, along with the following detailed discussion, the construction and operation of several alternate embodiments for the present invention can best be understood. In addition, further alternate embodiments and constructions can be implemented using the teaching of the present invention. Consequently, it is to be understood that the following detailed disclosure and specific embodiments shown herein are provided for exemplary purposes only and are not intended as a limitation of the present invention.

Figure 1:
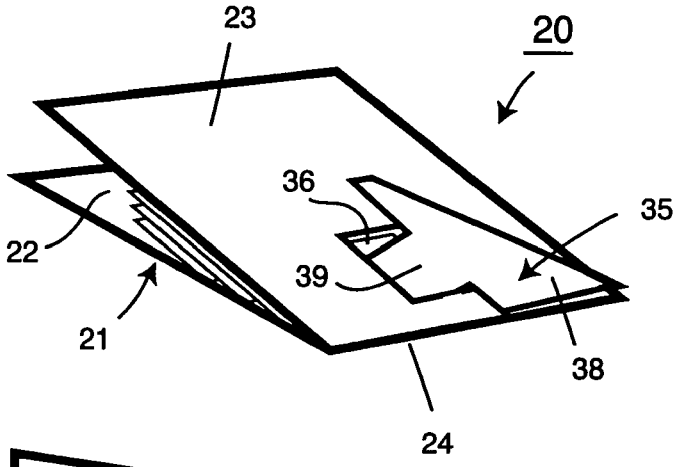
FIG. 1 is a rear perspective view of one embodiment of the multi-panel display system of present invention shown in its first, collapsed position.
Figure 2:
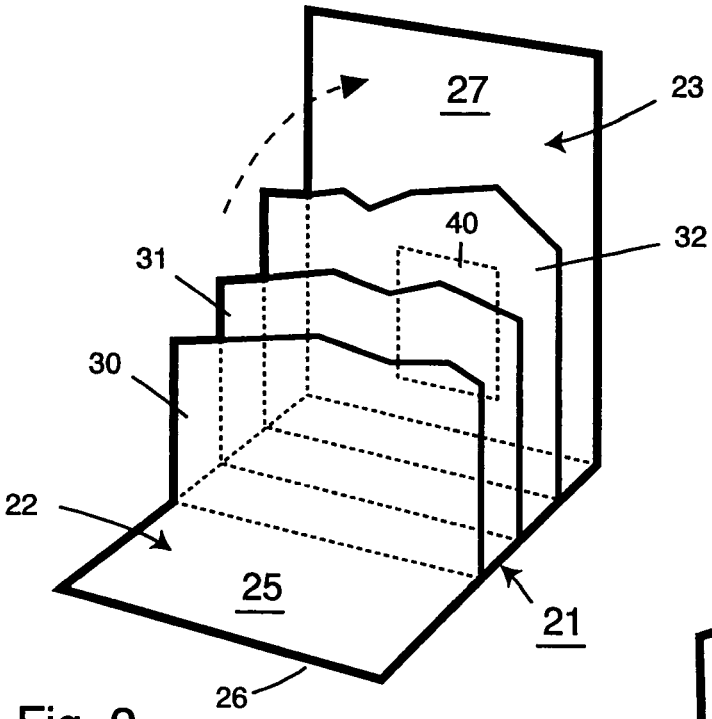
FIG. 2 is a front perspective view of the multi-panel display system of FIG. 1 shown in its second, fully erect, three-dimensional position.
Figure 3:
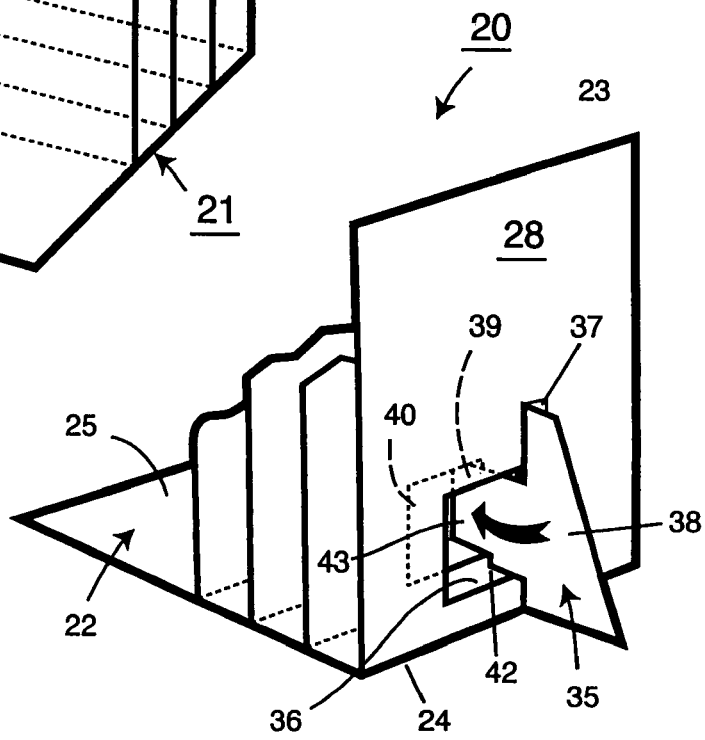
FIG. 3 is a rear perspective view of the multi-panel display system of FIG. 2, shown with the combined arm/stand member pivoted for locked engagement.

In FIGS. 1-3, one embodiment of the multi-panel advertising/ promotional display system 20 of the present invention is depicted in the form of a diorama. In this embodiment, advertising/promotional display system 20 comprises housing 21 which incorporates panel members 22 and 23, which are constructed for arcuate pivoting movement relative to each other.

In the preferred construction, panel members 22 and 23 are joined along the edge 24 enabling panels 22 and 23 to arcuately pivot from a first, fully collapsed, two-dimensional configuration, as depicted in FIG. 1, to a fully erect, three-dimensional, multi-panel display configuration shown in FIG. 2. In addition, panel member 22 comprises an inside surface 25 and an outside surface 26, while panel member 23 comprises an inside surface 27 and an outside surface 28. In this embodiment, panel members 22 are in overlying relationship with each other in the first position and at substantially right angles to each other in the second position.

Housing 21 also incorporates display panel members 30, 31, and 32, each of which are mounted to inside surface 25 of panel member 22 and are constructed for being movable from a fully collapsed position to a fully erect position. In providing this construction, conventional construction methods are employed, such as base portions for supporting each panel member and interconnecting plates extending between adjacent panel members for positioning and supporting the panels.

In order to provide an interest generating, eye-catching visually stimulating advertising/promotional display system 20, panel members 30, 31, and 32 along with surface 25 of panel member 22 and surface 27 of panel member 23 all incorporate visual indicia which produce the desired eye-catching, stimulating effect. Preferably, in this embodiment of the present invention, a diorama display is provided, with indicia formed on each panel member designed with a common theme, with each member cooperating with adjacent panel members. In this way, a fully integrated, visually distinctive, eye-catching, stimulating display is realized.

In order to further enhance the advertising/promotional display system 20 of the present invention the display assembly is constructed to be securely locked in the three-dimensional erect position, as well as incorporate a rearwardly extending support stand for further enhancing the stability of the display system. In order to achieve this unique locking and stabilizing construction, advertising/promotional display system. 20 of the present invention incorporates integrated arm/stand member 35 pivotally mounted to panel 23 of housing 21.

As depicted, panel 23 incorporates a cutout zone 36 formed therein with integrated arm/stand member 35 mounted in cooperating relationship with cutout zone 36. In the preferred embodiment, arm/stand member 35 incorporates a mounting strip 37 which is secured to rear surface 28 of panel member 23, enabling arm/stand member 35 to be arcuately pivotable relative to rear surface 28 of panel member 23.

In the preferred embodiment of the present invention, arm/stand member 35 incorporates stand portion 38 and arm portion 39, with both portions aligned in substantially the same plane. By employing this construction, stand portion 38 extends rearwardly from outside surface 28 of rear panel member 23, while arm portion 39 extends forwardly from inside surface 27 of a rear panel 23 when arm/stand member 35 is pivoted into its locking and stabilizing position. In addition, since arm portion 39 and stand portion 38 are both integrally mounted to mounting strip 37, both portions arcuately pivot simultaneously between their two alternate positions, for cooperating quickly and easily with the movement of housing 21 between its two alternate positions.

In order to provide the desired locked engagement and stabilization of housing 21 in its second, fully erect, three-dimensional, multi-panel displaying position, panel member 32 incorporates cutout zone 40 formed therein which is dimensioned for cooperating relationship with arm portion 39. Furthermore, arm portion 39 incorporates step or ledge 42 formed along the length thereof, positioned for cooperating, locking engagement with an edge of cutout zone 40.

In this way, when arm/stand member 35 is arcuately pivoted from its collapsed position to its engaging and stabilizing position, arm portion 39 pivots from overlying engagement with inside surface 27 of panel 23 to its second position substantially 90° to surface 27 of panel 23. As arm portion 39 arcuately pivots into its second position, terminating end 43 of arm portion 39 extends through cutout zone 40 of panel 32, enabling step/ledge 42 to engage a portion of panel 32 along cutout zone 40.

Once in this position, arm/stand member 35 is securely locked in engagement therewith, stabilizing rear panel 23, interior panel 32, and the entire display provided by housing 21. In addition., stand portion 38 extends rearwardly from panel 23, providing a further secure, stabilizing and holding member for maintaining advertising/promotional display system 20 in the fully erect, three-dimensional, multi-panel displaying configuration.

Figure 4:
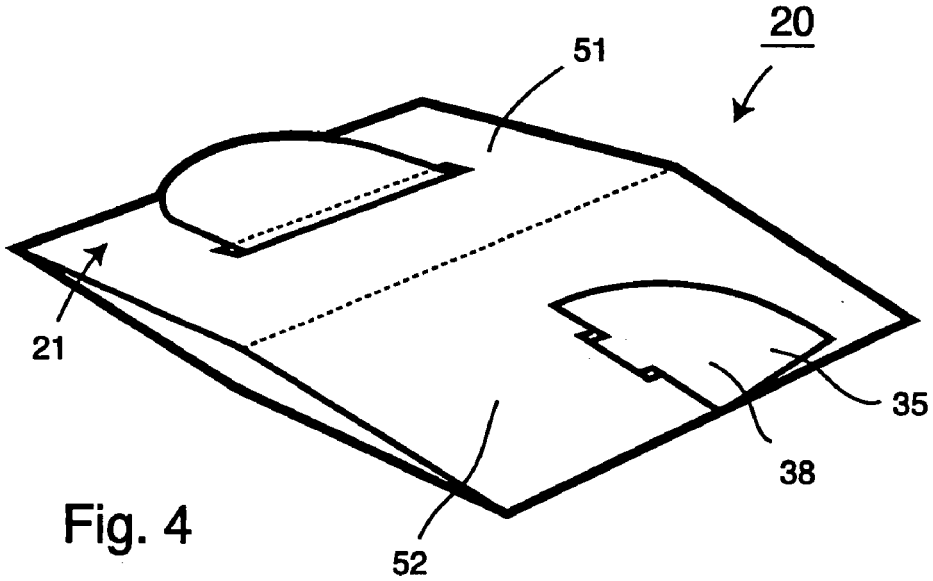
FIG. 4 is a rear perspective view of an alternate embodiment of the multi-panel display system of the present invention shown in its first, collapsed position.
Figure 5:
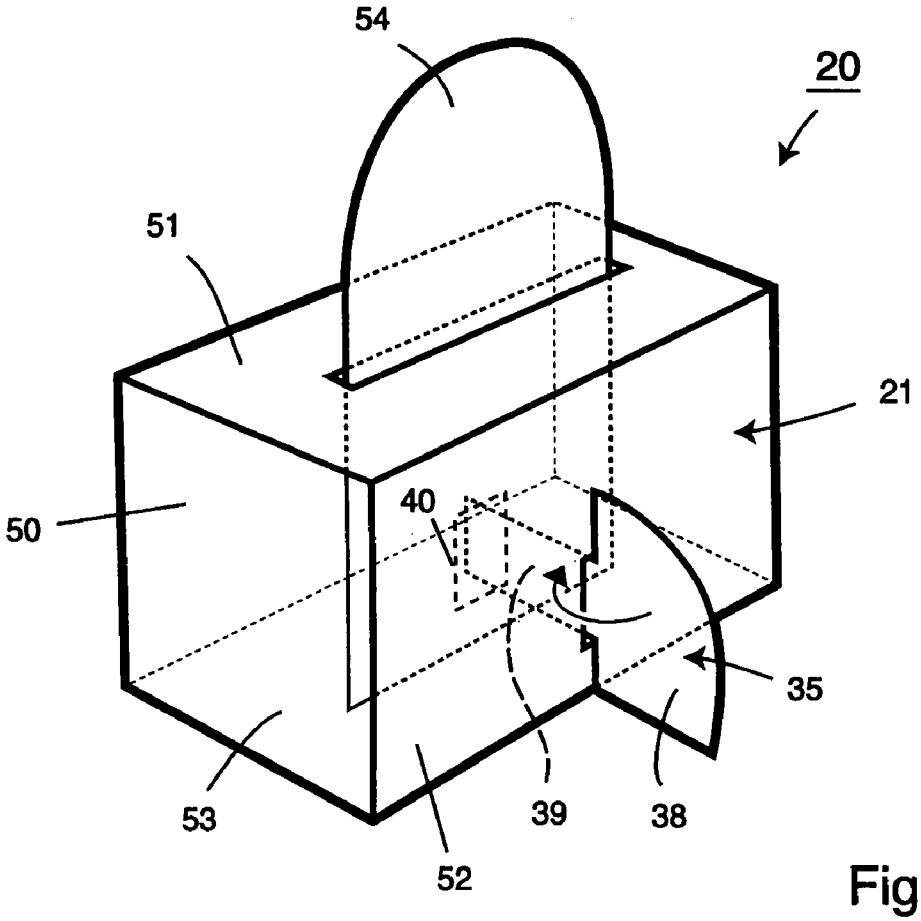
FIG. 5 is a rear perspective view of the multi-panel display system of FIG. 4 shown in its second, fully erect, three-dimensional position with the combined arm/stand member in its locked engaged position.

In FIGS. 4 and 5, an alternate embodiment of advertising/promotional display system 20 of the present invention is depicted. In this embodiment, housing 21 incorporates a plurality of panel members 50, 51, 52, and 53, each of which are affixed to an adjacent panel member along the opposed edges thereof. As a result, a substantially hollow, rectangular shaped display member is realized.

In addition, advertising/promotional display member 20 incorporates an interior panel member 54 which is mounted in an elongated slot formed in panel member 51. By employing this construction, a generally vertically disposed, interiorly positioned display member is realized. Furthermore, arm/stand member 35 is mounted to panel 52 for arcuate pivoting movement relative thereto.

In the preferred embodiment, interior-panel member 54 incorporates cutout zone 40 formed therein for cooperating with arm/stand member 35. As best seen in FIG. 5, this embodiment of the present invention incorporates arm/stand member 35 constructed in a manner similar to the construction detailed above. In this regard, arm/stand member 35 is arcuately pivotable relative to panel member.52 between a first,.collapsed, folded position and a second, fully erect, assembled position, wherein arm portion 39 lockingly engages interior panel 54 through cutout zone 40, while stand portion 38 extends rearwardly from panel member 52.

As a result, when arm/stand member 35 is mounted in its second, locked engaged position, advertising/promotional display system 20 is maintained in its fully erect configuration, lockingly secured in that position, preventing unwanted collapse or folding. In addition, by forming interest generating, eye-catching, visually stimulating indicia on the surfaces of panel members 50, 51, 52, 53, and 54, the desired exciting, advertising/promotional display system 20 is realized, enabling the user to retain display system 20 in its fully erect configuration for long term enjoyment and appreciation.

Figure 6:
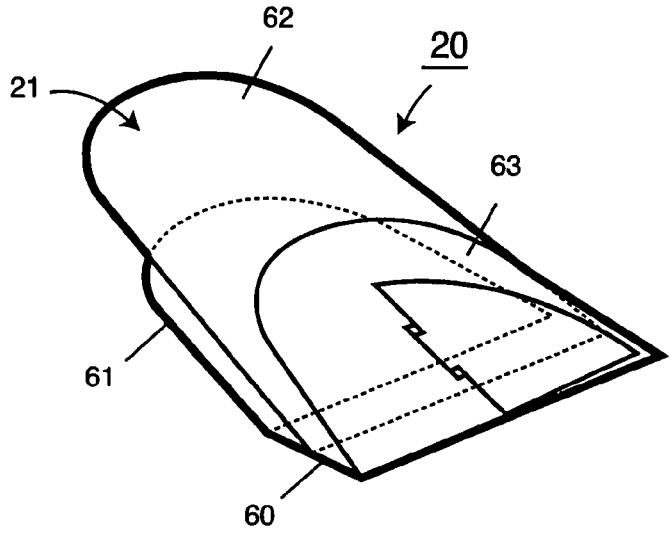
FIG. 6 is a rear perspective view of a further alternate embodiment of the multi-panel display system of the present invention shown in its first, collapsed position.
Figure 7:
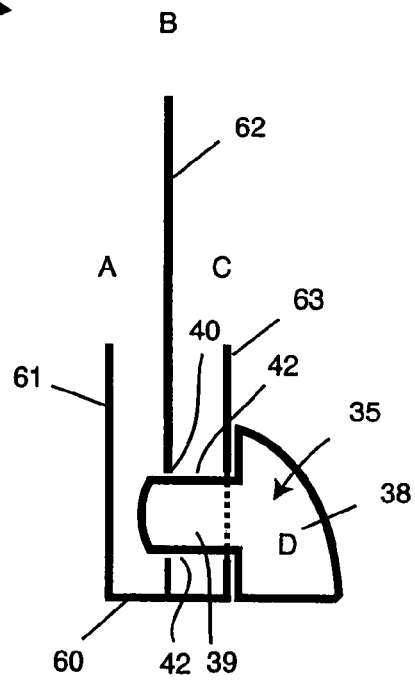
FIG. 7 is a side elevation view of the multi-panel display system of FIG. 6 shown in its second, fully erect, three-dimensional position with the combined arm/stand member in its locked, engaged position.
Figure 8:
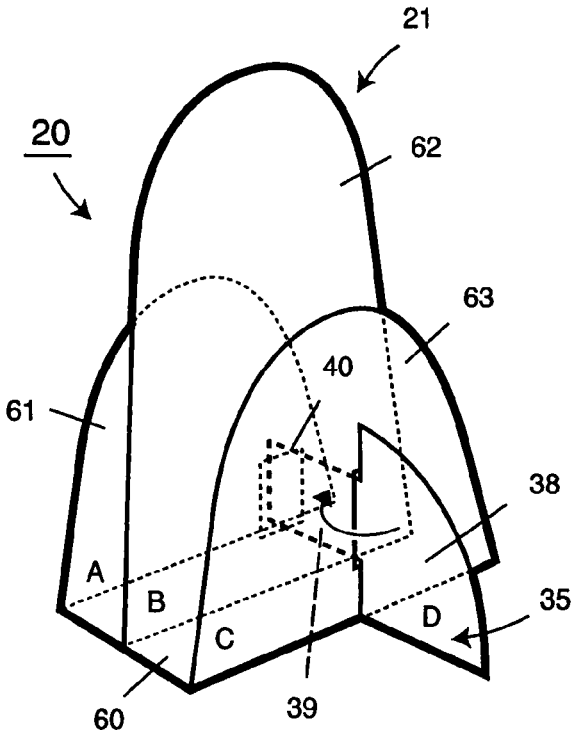
FIG. 8 is a rear perspective view of the multi-panel display system of FIG. 7.

In FIGS. 6, 7, and 8, a further alternate embodiment of the present invention is depicted. In this embodiment,.advertising/promotional display system 20 comprises housing 21 which incorporates base panel 60 on which vertically disposed panels.61, 62, and 63 are mounted. Panels 61, 62, and 63 are constructed for being foldable relative to base panel 60, thereby enabling this embodiment of housing 21 to be easily folded into a first, substantially flat, two-dimensional configuration, as shown in FIG. 6, into a second, fully erect, three-dimensional configuration, as shown in FIGS. 7 and 8.

In this embodiment of the present invention, arm/stand member 35 is pivotally mounted to panel 63 for arcuate movement relative thereto. As with the embodiment detailed above, arm/stand member 35 arcuately pivots between a first, collapsed, stowed position, as'shown in FIG. 6, to a second, lockingly engaging and stabilizing position, as shown in FIG. 7 and 8. In this way, arm/stand member 35 is able to be quickly and easily arcuately moved from its first, collapsed position into its fully assembled position wherein stand portion 38 extends rearwardly substantially perpendicularly from the rear surface of panel 63, while arm portion 39 extends forwardly from the inside surface of panel member 63.

Furthermore, interior panel 62 incorporates cutout zone 40 which is constructed for mating, locking engagement with arm portion 39 of arm/stand member 35. As a result, when arm portion 39 is pivoted into its second position, arm portion 39 extends through cutout zone 40, with ledge/step portion 42 lockingly engaging the surface of panel 62, in order to provide the desired locked interengagement and stabilization of housing 20 when in its three-dimensional, displaying configuration.

As detailed above, each of the panel members of this embodiment of the present invention incorporates visually distinctive, eye-catching, and interest generating indicia formed thereon, in order to achieve an advertising/ promotional display system providing the desired information to the consumer in a manner which encourages the user to maintain advertising/display system 20 in the fully erect, locked and stabilizing configuration. Furthermore, by incorporating the features detailed above, advertising/promotional display system 20 is maintained in the fully erect position, with unwanted collapse or folding virtually eliminated.

In FIGS. 9-12, a still further alternate embodiment of the present invention is depicted. In this embodiment, advertising/promotional display system 20 comprises housing 21 which incorporates a plurality of panels which are supportingly interconnected with each other. As depicted, housing 21 comprises base panel 70, front panel 71, rear panel 72, and intermediate panel 73.

Figure 9:
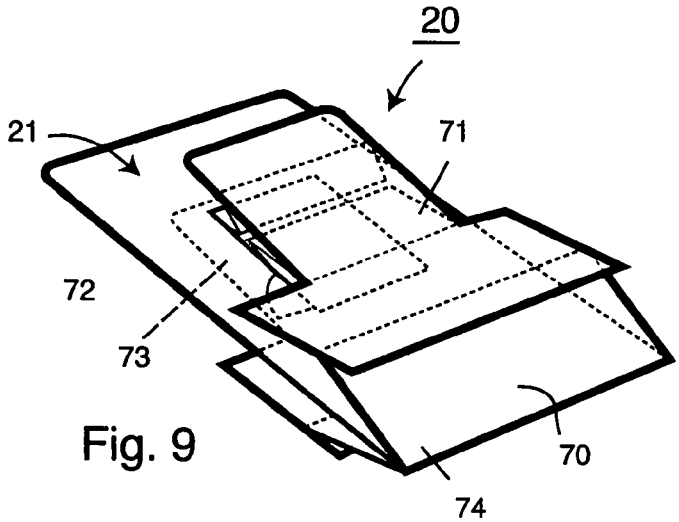
FIG. 9 is a perspective view of a still further alternate embodiment of the multi-panel display system of the present invention shown in its first, collapsed position.
Figure 10:
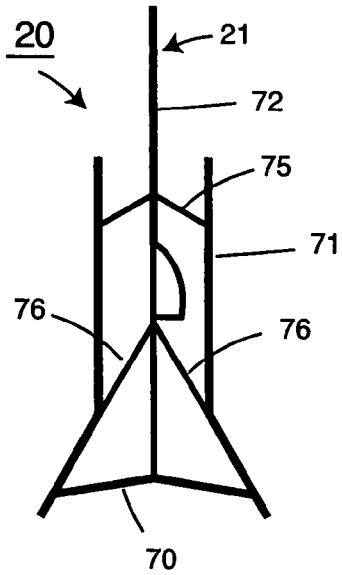
FIG. 10 is a side elevation view of the multi-panel display system of FIG. 9 shown in its second, fully erect, three-dimensional position with its locking finger fully engaged.
Figure 11:
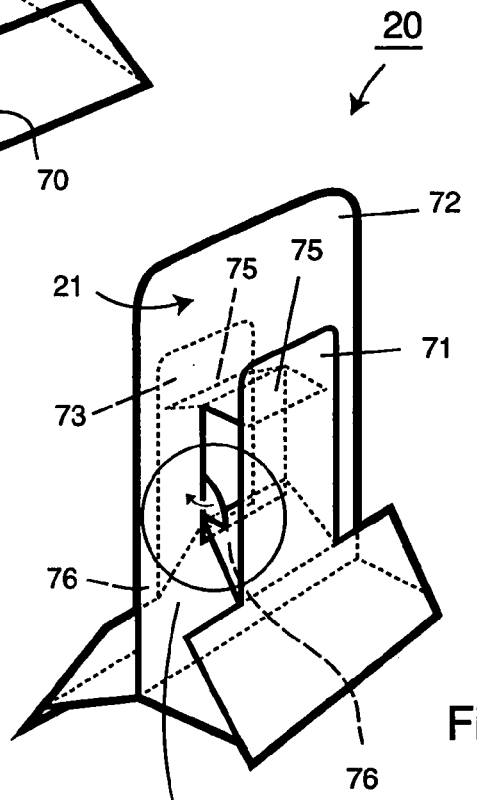
FIG. 11 is a perspective view of the multi-panel display system of FIG. 9.

In the preferred construction of this embodiment of the present invention, base panel 70 is foldable along fold line 74 for enabling base panel 70 to be folded substantially midway along its width. In addition, connecting arm 75 extends between panels 71, 72, and 73 in the upper region of panel 71 and 73, while connecting arm 76 extends between panel 71, 72, and 73 in the lower region of panels 71 and 73. By employing this construction, as well as enabling panel 71 and 73 to be foldable, if needed, this embodiment of advertising/ promotional display system 20 is capable of being easily placed in a substantially flat, two-dimensional configuration, as depicted in FIG. 9, and quickly and easily moved into a fully erect, three-dimensional configuration as depicted in FIGS. 10 and 11.

In the preferred construction, panel 72 incorporates cutout zone 77 through which connecting arm 76 extends. In this way, connecting arm 76 is capable of moving upwardly through cutout zone 77 whenever housing 21 is moved from its second, fully erect, three-dimensional configuration into its first, substantially flat, two-dimensional configuration.

In addition, in order to assure that housing 21 is maintained in its second, fully erect, three-dimensional configuration, .when desired, with complete assurance that unwanted collapse or folding is eliminated, housing 21 incorporates arcuately pivotable-locking-finger 80. In the preferred embodiment, locking finger 80 is mounted along a side edge of cutout zone 77 and is constructed for cooperating engagement with connecting arm 76 in order to secure housing 21 in the three-dimensional configuration.

Figure 12:
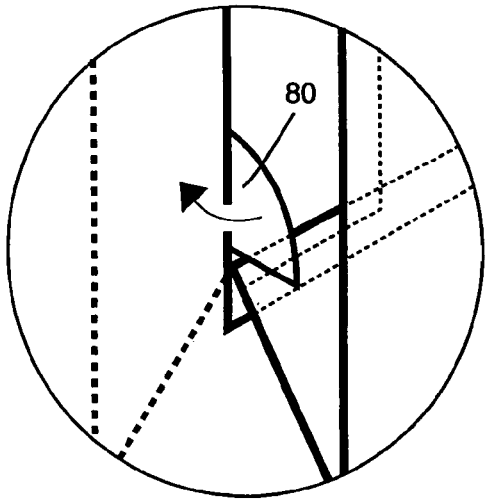
FIG. 12 is an enlarged perspective view detailing portion 12 of FIG. 11.

As best seen in FIG. 12, when locking finger 80 is positioned in overlying, contact engagement with connecting arm 76, connecting arm 76 is incapable of sliding upwardly through cutout zone 77, thereby preventing housing 21 from being able to move into its collapsed configuration. However, whenever housing 21 is to be collapsed into its two-dimensional configuration, locking finger 80 is arcuately pivoted out of engagement with connecting arm 76, thereby enabling connecting arm 76 to fold and slide upwardly through cutout zone 77 enabling panels 71 and 73 to be brought into contact with panels 72.

As detailed above in each of the alternate embodiments, eye-catching, visually distinctive, interest generating indicia is printed on the surface of panels 70, 71, 72, and 73, in order to provide the desired advertising/promotional display system which can be enjoyed and appreciated by all observers, particularly when maintained in the seconds fully erect, three-dimensional configuration.

It will thus be seen that the objects set forth above, among those made apparent from the preceding description, are efficiently attained and, since certain changes may be made in the above article without departing from the scope of the invention, it is intended that all matter contained in the above description or shown in the accompanying drawings shall be interpreted as illustrative and not in a limiting sense.

It is also to be understood at the following claims are intended to cover all of the generic and specific features of the invention herein described,.and all statements of the scope of the invention which, as a matter of language, might be said to fall therebetween.

The invention claimed is:

1. An advertising/promotional display system comprising:

A. a first panel and a second panel, interconnected to each other, with said first panel and said second panel each comprising separate, single, substantially flat members integrally affixed to each other along a single, common fold line, whereby the first flat panel is pivotable into overlying engagement with the second flat panel when in a first, folded position and arcuately pivoted into a second display position wherein said first panel and said second panel are substantially perpendicular to each other forming an L-shape display;

B. a third panel a. mounted along one terminating edge thereof to the second panel in pivotal relationship therewith, wherein said third panel is positioned in juxtaposed, spaced, substantially parallel facing relationship with the first panel when in the second position, and b. comprising a cutout zone or aperture formed therein and positioned for being in spaced, substantially parallel, facing relationship with the surface of the first panel and positioned for receiving and securely maintaining the terminating end of a combined locking and supporting member;

C. the combined locking and supporting member comprising:

a. a substantially flat plate integrally affixed and pivotally mounted to the first panel for being movable between a first stowed position wherein the locking and supporting member is in overlying, aligned relationship with the first panel and a second engaged position, wherein said locking and supporting member extending through a passageway of the first panel;

b. an integrated support section formed by a first portion of the locking and supporting member and constructed for stabilizing and maintaining the first panel in an erect position when said supporting member is in its second engaged position with the support section extending rearwardly from the first panel, and c. a locking section formed by a second portion of the locking and supporting member and constructed for extending forwardly from the first panel when in its second position and positioned for cooperating engagement in the cutout zone or aperture of the third panel for engaging the third panel and maintaining the third panel in an erect position when said locking and supporting member is in its second, engaged position.

2. The advertising/promotional display system defined in claim 1, wherein the combined locking and supporting member further comprises a flange portion integrally attached thereto and affixed to one surface of the first panel for enabling the locking and supporting member to be arcuately pivoted relative to the flange portion.

3. The advertising/promotional display system defined in claim 2, wherein the support portion and the locking portion of the locking and supporting member are further defined as being formed in a single plane.

4. The advertising/promotional display system defined in claim 1, wherein the terminating end of the locking portion incorporates an integrally formed flange section constructed for contacting the surface of the third panel when the locking portion of the locking and supporting member is engaged therewith, thereby providing the further frictional contact and engagement of the locking and supporting member with the third panel.

5. The advertising/promotional display system defined in claim 4, wherein the third panel is further defined as being pivotally mounted to the second panel along the one terminating edge of the third panel, thereby enabling the third panel to be pivoted into overlying engagement between the first panel and the second panel when the display system is in its first folded configuration and arcuately pivoted 90° relative to the second panel when the display system is pivoted into its second position.

6. The advertising/promotional display system defined in claim 5, wherein said system further comprises a plurality of additional panels each being pivotally mounted to the second panel in juxtaposed, spaced, cooperating relationship to each other, with each of said additional panels being arcuately pivoted into a first position for overlying engagement in the first folded configuration and arcuately pivoted into a second position wherein each of the panels are substantially perpendicular to the second panel.

7. The advertising/promotional display system defined in claim 1, wherein each of the panel members forming the display system are further defined as comprising surfaces each of which are formed with eye-catching printed indicia thereon for producing a desired visual information display for generating consumer interest.

8. The advertising/promotional display system defined in claim 7, wherein the printed indicia formed on each panel member are coordinated to represent a single theme.

9. The advertising/promotional display system defined in claim 1, wherein the locking and supporting member is further defined as extending through the passageway of the first panel for enabling the locking portion thereof to extend from the first panel in a first direction and enabling the support portion to extend from the first panel in an opposite direction.

10. An integrated advertising/promotional display system comprising:

A. a first panel and a second panel, interconnected to each other, with said first panel and said second panel each comprising separate, single, substantially flat members integrally affixed to each other along a single, common fold line, whereby the first flat panel is pivotable into overlying engagement with the second flat panel when in a first, folded position and arcuately pivoted into a second display position wherein said first panel and said second panel are substantially perpendicular to each other, forming an L-shaped display, and said first panel incorporates a passageway formed therein;

B. a third panel a. integrally mounted to the second panel, b. comprising a cutout zone or aperture formed therein and positioned for being in spaced, substantially parallel, facing, relationship with the surface of the first panel and positioned for receiving and securely maintaining the terminating end of a combined locking and supporting member, and c. being pivotally mounted to the second panel along one terminating edge thereof, enabling the third panel to be pivoted into overlying engagement between the first panel and the second panel when the display system is in its first folded configuration and arcuately pivoted 90° relative to the second panel when the display system is pivoted into its second position;

C. the combined locking and supporting member comprising a. a substantially flat plate integrally affixed to the first panel in cooperating relationship with the passageway formed therein, and b. pivotally mounted to the first panel for being movable between a first stowed position wherein the locking arid supporting member is in overlying, aligned relationship with the first panel and a second engaged position wherein said locking and supporting member extends through the passageway of the first panel at substantially right angles thereto arid defining a first portion and a second portion, c. an integrated support section formed by the first portion of the locking and supporting member and constructed for stabilizing and maintaining the first panel iii an erect position when said locking and supporting member is in its second engaged position with the support section extending rearwardly from the first panel, and d. a locking section formed by the second portion of the locking and supporting member and constructed for extending forwardly from the first panel when in its second position and positioned for cooperating engagement in the cutout zone of the third panel for engaging the third panel and maintaining the third panel in an erect position when said locking supporting member is in its second, engaged position.

11. The advertising/promotional display system defined in claim 10, wherein said system further comprises a plurality of additional panels each being pivotally mounted to the second panel in juxtaposed, spaced, cooperating relationship to each other, with each of said additional panels being arcuately pivoted into a first position for overlying engagement in the first folded configuration and arcuately pivoted into a second position wherein each of the panels are substantially perpendicular to the second panel.

* * * * *